US009180681B2

(12) United States Patent
Nakano et al.

(10) Patent No.: US 9,180,681 B2
(45) Date of Patent: Nov. 10, 2015

(54) PRINT APPARATUS, PRINT METHOD, AND PRINT SHEET

(71) Applicant: Seiko Epson Corporation, Tokyo (JP)

(72) Inventors: Tomoyuki Nakano, Shiojiri (JP); Katsuhito Suzuki, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/683,144

(22) Filed: Nov. 21, 2012

(65) Prior Publication Data

US 2013/0127941 A1 May 23, 2013

(30) Foreign Application Priority Data

Nov. 21, 2011 (JP) ..... 2011-253722

(51) Int. Cl.

| | |
|---|---|
| ***B41J 2/21*** | (2006.01) |
| ***B42D 15/00*** | (2006.01) |
| ***B41J 3/407*** | (2006.01) |
| ***B41M 3/00*** | (2006.01) |

(52) U.S. Cl.

CPC ..... *B41J 2/2117* (2013.01); *B41J 3/407* (2013.01); *B41M 3/003* (2013.01); *B42D 15/00* (2013.01); *B42D 15/0093* (2013.01)

(58) Field of Classification Search

CPC ..... B41J 2/21; B41J 2/2114; B41J 2/2117
USPC ..... 347/14
See application file for complete search history.

(56) References Cited

U.S. PATENT DOCUMENTS

| | | | | |
|---|---|---|---|---|
| 5,812,152 | A | 9/1998 | Torigoe et al. | |
| 6,193,347 | B1 * | 2/2001 | Askeland et al. | 347/15 |
| 2005/0122489 | A1 * | 6/2005 | Suzuki | 355/22 |
| 2007/0148375 | A1 * | 6/2007 | Suzuki et al. | 428/32.1 |
| 2007/0248774 | A1 | 10/2007 | Suzuki et al. | |
| 2010/0053267 | A1 * | 3/2010 | Seishin | 347/43 |
| 2011/0183088 | A1 * | 7/2011 | Shimizu et al. | 428/32.39 |
| 2011/0221805 | A1 * | 9/2011 | Yoshida et al. | 347/9 |
| 2011/0221807 | A1 * | 9/2011 | Yoshida | 347/9 |

FOREIGN PATENT DOCUMENTS

| | | | |
|---|---|---|---|
| EP | 841185 | A1 * | 5/1998 |
| JP | 08-137034 | A | 5/1996 |
| JP | 11-030825 | A | 2/1999 |
| JP | 11-142995 | A | 5/1999 |
| JP | 2000-029152 | A | 1/2000 |
| JP | 2007-030415 | A | 2/2007 |
| JP | 2007-334091 | A | 12/2007 |
| JP | 3143782 | U | 8/2008 |

* cited by examiner

*Primary Examiner* — Geoffrey Mruk
*Assistant Examiner* — Scott A Richmond
(74) *Attorney, Agent, or Firm* — Nutter McClennen & Fish LLP; John J. Penny, Jr.; Taylor M. Coon

(57) ABSTRACT

A print apparatus performing printing on a print medium that includes a lenticular lens and an ink absorption layer that absorbs ink includes a print head that ejects a plurality of types of ink and a control section that controls the driving of the print head. In the print apparatus, in a case in which at least one type of ink among the plurality of types of ink is ink the visibility of which is reduced when the ink is absorbed in the ink absorption layer, the control section controls ink different from the ink the visibility of which is reduced has been ejected before the ink the visibility of which is reduced dries when the ink the visibility of which is reduced is ejected on the side opposite to the mounting side of the lenticular lens in the print medium from the print head.

10 Claims, 9 Drawing Sheets

PRINT APPARATUS, PRINT METHOD, AND PRINT SHEET

BACKGROUND

1. Technical Field

The present invention relates to a print apparatus, a print method, and a print sheet.

2. Related Art

In the related art, a print medium with a lenticular lens is known with which a printed image can be viewed as a three-dimensional image or a moving image (alternate image). For example, as discussed in JP-A-11-30825, JP-A-2000-29152, JP-A-11-142995, Japanese Utility Model No. 3143782, and JP-A-2007-30415, such a print medium can be visually recognized as a three-dimensional image, etc. when the image is viewed through the lenticular lens, by forming the three-dimensional image or an image for a moving image on the back surface (surface opposite to a surface where a lens surface is located) of the print medium.

In JP-A-11-30825, JP-A-2000-29152, JP-A-11-142995, and Japanese Utility Model No. 3143782, the formation of an image on the back surface of a print medium is performed by offset printing, transfer from a transfer paper on which an image appears, or thermosensitive recording on a thermosensitive coloring layer formed on the back surface of the print medium. On the other hand, in JP-A-2007-30415, an ink absorption layer is formed on the back surface of a print medium, and printing is performed on the ink absorption layer by a print apparatus. In the print medium on which the ink absorption layer is formed, an image formed by ink absorbed in the ink absorption layer can be viewed through a lens.

In the print medium that does not include an ink absorption layer as discussed in JP-A-11-30825, JP-A-2000-29152, JP-A-11-142995, and Japanese Registered Utility Model No. 3143782, there is no problem that the visibility of an image is reduced depending on the type of ink. However, in the print medium on which an image is formed by the ink absorbed in the ink absorption layer as discussed in JP-A-2007-30415, it is probable that the visibility of the printed image is reduced depending on the type of the ink (material, color, etc.) as compared with a case in which the printing is performed on a transparent sheet that does not include the ink absorption layer.

SUMMARY

Therefore, an advantage of some aspects of the present invention is that there are provided a print apparatus and a print method by which the visibility of an image the visibility of which is reduced due to being printed on an ink absorption layer of a print medium with a lenticular lens can be improved, and a print sheet in which the visibility of an image the visibility of which is reduced is improved.

The print apparatus performs printing on a print medium including a lenticular lens and an ink absorption layer that is located on a surface opposite to the surface where the lenticular lens is located, and includes a plurality of types of ink, a print head that ejects the plurality of types of ink, and a control section that controls the driving of the print head. In the print apparatus, in a case in which at least one type of ink among the plurality of types of ink installed in the print apparatus is first ink the visibility of which is reduced after the first ink is absorbed in the ink absorption layer as compared with the visibility before the absorption, when the first ink is ejected from the print head to the ink absorption layer of the print medium, the control section controls second ink different from the first ink to be ejected to at least the location to which the first ink has been ejected before the first ink dries.

The print apparatus is configured as described above, so that the visibility of the printed ink the visibility of which is reduced can be improved.

In addition to the above-described invention, in the print apparatus, the control section may control the second ink to be further ejected to the location to which the first ink and the second ink have been ejected and the first ink has dried. In addition, in the print apparatus, the control section may control ink different from the first ink and the second ink to be further ejected to the location to which the first ink and the second ink have been ejected and the first ink has dried.

The print apparatus is configured as described above, so that the visibility of the printed ink the visibility of which is reduced can be further improved.

In the above-described invention, the first ink the visibility of which is reduced is at least one of yellow, light cyan, and light magenta.

The print apparatus is configured as described above, so that the visibility can be improved for the ink of yellow, light cyan, and light magenta.

In the above-described invention, the second ink different from the first ink the visibility of which is reduced is at least one of transparent ink, white ink, and metallic ink.

The print apparatus is configured as described above, so that the visibility of the printed ink the visibility of which is reduced can be further improved.

In addition to the above-described invention, in the print apparatus, an ink permeation layer through which ink passes is laminated on a side that receives the ink in the ink absorption layer in the print medium, and the control section controls the first ink to be ejected to the ink permeation layer and controls the second ink to be ejected to the location to which the first ink has been ejected in the ink permeation layer.

The print apparatus is configured as described above, so that the visibility of an image including the first ink the visibility of which is reduced when the ink is absorbed in the ink absorption layer and the second ink of which reduction of the visibility when the ink is absorbed in the ink absorption layer is small as compared with the first ink can be improved.

In addition to the above-described invention, the ink permeation layer is semi-permeable so as to scatter light.

The print apparatus is configured as described above, so that the visibility of the ink the visibility of which is reduced when the ink is absorbed in the ink absorption layer can be desirably improved.

The print method performs printing by ejecting ink on a print medium that includes a lenticular lens and an ink absorption layer that absorbs the ink and is located on a surface opposite to the surface where the lenticular lens is located. The print method includes ejecting ink from a print head to the ink absorption layer of the print medium and ejecting, when the ejected ink is first ink the visibility of which is reduced after the first ink is absorbed in the ink absorption layer as compared with the visibility before the absorption, second ink different from the first ink the visibility of which is reduced, to at least the location to which the first ink the visibility of which is reduced has been ejected before the first ink dries.

The print method is configured as described above, so that the visibility of the ink that is ejected to the ink absorption layer and the visibility of which is reduced can be improved.

In addition to the above-described invention, in the print apparatus, an ink permeation layer through which ink passes is laminated on a side that receives the ink in the ink absorbing layer in the print medium, and the ink permeation layer is semi-permeable so as to scatter light.

The print method is configured as described above, so that the visibility of the ink that is ejected to the ink absorption layer and the visibility of which is reduced can be further improved.

A control program for the print apparatus is configured as described above that performs printing by ejecting ink on the print medium that includes a lenticular lens and the ink absorption layer that absorbs ink, so that the visibility of the ink that is absorbed in the ink absorption layer and the visibility of which is reduced can be improved.

The print sheet includes a print medium including a lenticular lens and an ink absorption layer located on a surface opposite to the surface where the lenticular lens is located. In the print matter, an image is formed by ink the visibility of which is reduced due to the absorption of the ink in the ink absorption layer on the lenticular lens side, and ink of which reduction of the visibility is suppressed is placed on the side opposite to the lenticular lens side.

The print sheet is configured as described above, so that the visibility of the ink that is absorbed in the ink absorption layer and the visibility of which is reduced can be improved.

In addition to the above-described invention, in the print sheet, an ink permeation layer through which the ink passes is laminated on the surface of the ink absorption layer on the side opposite to the lenticular lens side, and the ink permeation layer is semi-permeable so as to scatter light.

The print sheet is configured as described above, so that the visibility of the ink that is absorbed in the ink absorption layer and the visibility of which is reduced can be further improved.

DESCRIPTION OF EXEMPLARY EMBODIMENTS

Outline of the Invention

Figure 1:
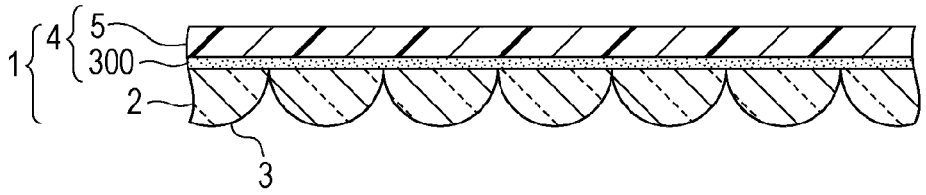
FIG. 1 is a diagram illustrating schematic configuration of a cross-section of the lenticular lens sheet.

As illustrated in FIG. 1, a lenticular lens sheet 1 (hereinafter, simply referred to as a lens sheet) as a print sheet includes a lenticular lens 2 in which dome-shaped lenses are arranged and a print medium 4 on which the lenticular lens 2 is mounted and that includes an ink absorption layer 5 absorbing ink. The print medium 4 includes a bonding layer 300 on a mounting side of the lenticular lens 2. The lenticular lens 2 is mounted on the print medium 4 in a state of being bonded to the ink absorption layer 5 by the bonding layer 300. The bonding layer 300 may be configured as an adhesive layer. An image recorded in the ink absorption layer 5 can be visually recognized through the lenticular lens 2 in the lens sheet 1. Thus, for example, an image having parallax (hereinafter, simply referred to as a print image) is printed on the ink absorption layer 5 so as to be compatible with the disposition pitch and focal length, etc. of the lenticular lens 2, and the print image can be visually recognized as a three-dimensional image, etc. when the print image is viewed from a lens surface 3 side.

The ink absorption layer 5 absorbs ink, and the ink permeates into the ink absorption layer 5 and becomes fixed on the lenticular lens 2 side. In the ink absorption layer 5, a print image is formed by the absorbed ink. When the lens sheet 1 is viewed from a front surface side by a viewer, the print image formed in the ink absorption layer 5 can be viewed through the lenticular lens 2 by the viewer. The print image formed on the ink absorption layer 5 can be formed at a specific position relative to the lenticular lens 2 because the ink absorbed in the ink absorption layer 5 is fixed in the ink absorption layer 5. Therefore, when the print image is viewed from the lenticular lens 2 side, the three-dimensionality of a three-dimensional image and the change in state of a moving image can be visually recognized desirably. The ink absorption layer 5 may be formed using, for example, a hydrophilic polymer resin such as polyvinyl alcohol (PVA), a cationic compound, fine particles such as silica particles, etc., as a material.

The applicant has found a phenomenon in which a portion printed with yellow ink (hereinafter referred to as Y-ink) has low saturation and low visibility in a print image printed on the lens sheet 1. On the other hand, when a yellow image is printed on a nonabsorbable print medium that does not include the ink absorption layer 5 such as a transparent sheet for an overhead projector (OHP) using the Y-ink, a clear reduction in visibility is not observed. That is, the applicant has found a phenomenon in which the saturation and the visibility of the image become low when the Y-ink is absorbed in the ink absorption layer 5 as compared with the case in which a yellow image is printed on a print medium that does not include the ink absorption layer 5.

The applicant who has found the above-described phenomenon has tried to improve the visibility of an image the visibility of which is reduced (hereinafter referred to as a low visibility image) printed using ink with which the visibility of the print image is reduced when the ink is absorbed in the ink absorption layer 5 (hereinafter referred to as low visibility ink) such as Y-ink. As a result, this has led to the invention of a print method in which the visibility of an image the visibility of which is reduced can be improved by for example, ejecting metallic ink different from the low visibility ink to the location to which the low visibility ink has been ejected on the side opposite to the mounting side of the lenticular lens 2 (hereinafter referred to as a back surface side) in the ink absorption layer 5 of the lens sheet 1 before the low visibility ink dries. The method in which the metallic ink is ejected to the location to which the low visibility ink has been ejected on the side opposite to the mounting side of the lenticular lens 2 in the lens sheet 1 may be performed by ejection such as spraying and may be performed by ejection using a print apparatus 7 as described below.

Embodiments

Next, the print apparatus 7 according to an embodiment of the present invention is described. The invention of the print apparatus 7 is made based on the invention of the print method described above, and the visibility of a low visibility image formed on the lens sheet 1 can be improved. The print method, a control program of the print apparatus 7, and a print sheet are described in accordance with the configuration and operations of the print apparatus 7.

Schematic Configuration of the Print Apparatus 7

Figure 2:
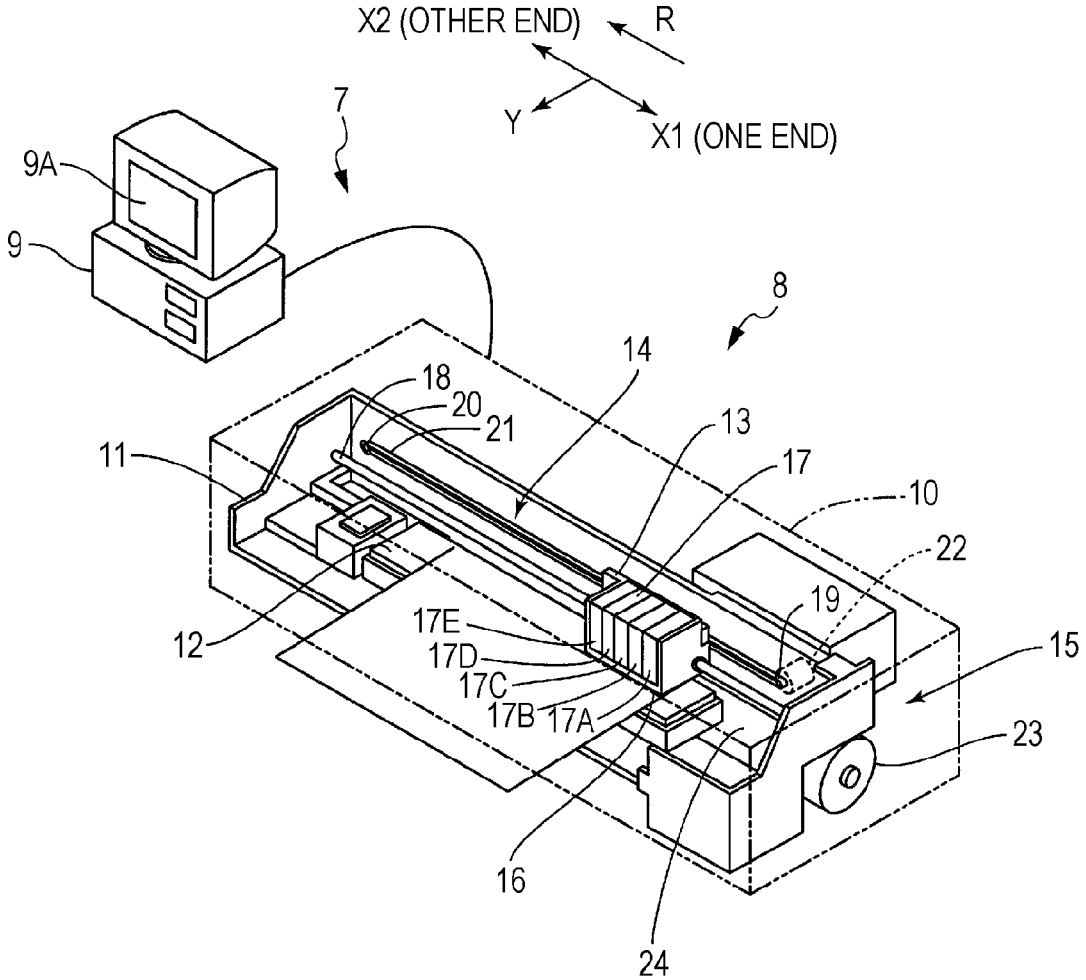
FIG. 2 is a diagram illustrating schematic configuration of the exterior of a print apparatus according to the present invention.
Figure 3:
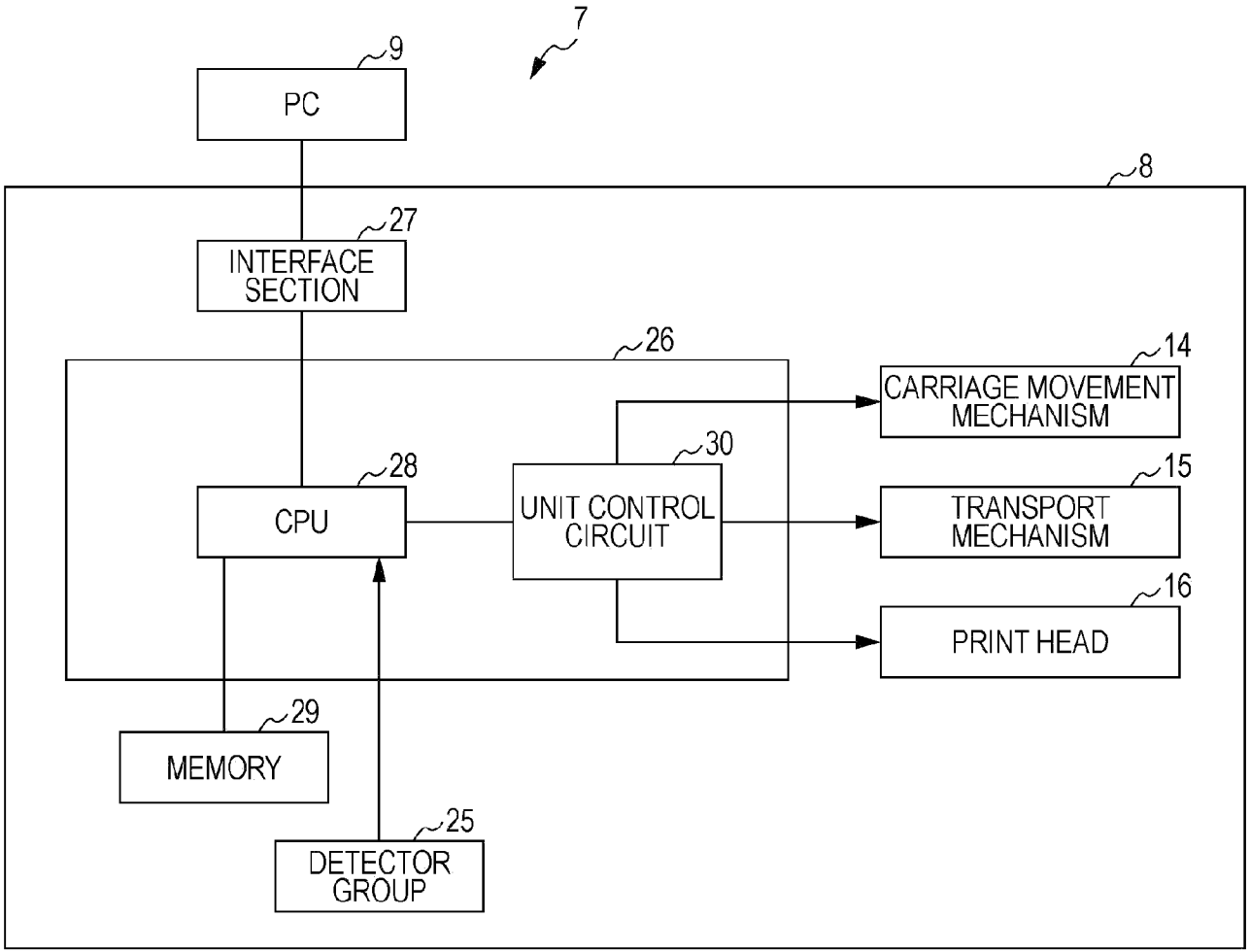
FIG. 3 is a block diagram illustrating electrical configuration of the print apparatus illustrated in FIG. 2.

FIG. 2 is a diagram illustrating the schematic configuration of the exterior of a portion of a printer 8 in the print apparatus 7 according to the invention. FIG. 3 is a block diagram illustrating the electrical configuration of the print apparatus 7. The print apparatus 7 can form a print image for the lens sheet 1 illustrated in FIG. 1, which is a print medium.

As illustrated in FIG. 2, the print apparatus 7 includes the printer 8 and a computer (hereinafter referred to as a PC) 9, etc. In the embodiment, the print apparatus 7 is configured so that the printer 8 and the PC 9 are different devices, and alternatively, the print apparatus 7 may be configured so that the printer 8 includes a function of the PC 9. The printer 8 includes an exterior housing 10, a frame 11 that is housed in the exterior housing 10, a platen 12 that is installed in a lower part inside the frame 11 (installation surface side of the printer 8) along a main scanning direction (X1-X2 direction illustrated in FIG. 2), a carriage movement mechanism 14 that moves a carriage in the main scanning direction, a transport mechanism 15 that transports the lens sheet 1, a print head 16 (see FIG. 3), and an ink tank 17. The print head 16 is provided on the lower surface of the carriage 13.

The carriage movement mechanism 14 includes the carriage 13, a guide shaft 18, a drive pulley 19 and a driven pulley 20, a timing belt 21, and a carriage motor 22. The carriage 13 is movably supported on the guide shaft 18 installed above the platen 12. The drive pulley 19 and the driven pulley 20 are rotatably supported at positions in the frame 11 corresponding to both ends of the guide shaft 18. The timing belt 21 spans between the drive pulley 19 and the driven pulley 20. The carriage 13 is fixed to the timing belt 21. The drive pulley 19 is connected to the carriage motor 22. Thus, the carriage 13 can be made to reciprocate along the guide shaft 18 through the timing belt 21 by the driving of the carriage motor 22.

The transport mechanism 15 includes a transport motor 23 and a transport roller 24 driven by the transport motor 23, and is configured so that the lens sheet 1 can be transported along the upper surface of the platen 12 in a sub-scanning direction orthogonal to the main scanning direction X (Y direction illustrated in FIG. 2) by the rotation of the transport roller 24.

The print head 16 is provided in the lower part of the carriage 13. The ink tank 17 is mounted on the carriage 13. The ink tank 17 includes an ink tank 17A in which, for example, metallic ink as ink different from low visibility ink (hereinafter referred to as non-low visibility ink) is stored, and ink tanks 17B, 17C, 17D, and 17E in which ink for forming a print image is stored. That is, a plurality of types of ink are stored in the ink tank 17. For example, types of ink of yellow (Y), magenta (M), cyan (C), and black (K) are stored in the ink tanks 17B, 17C, 17D, and 17E, respectively. As described above, Y-ink is low visibility ink.

Figure 4:
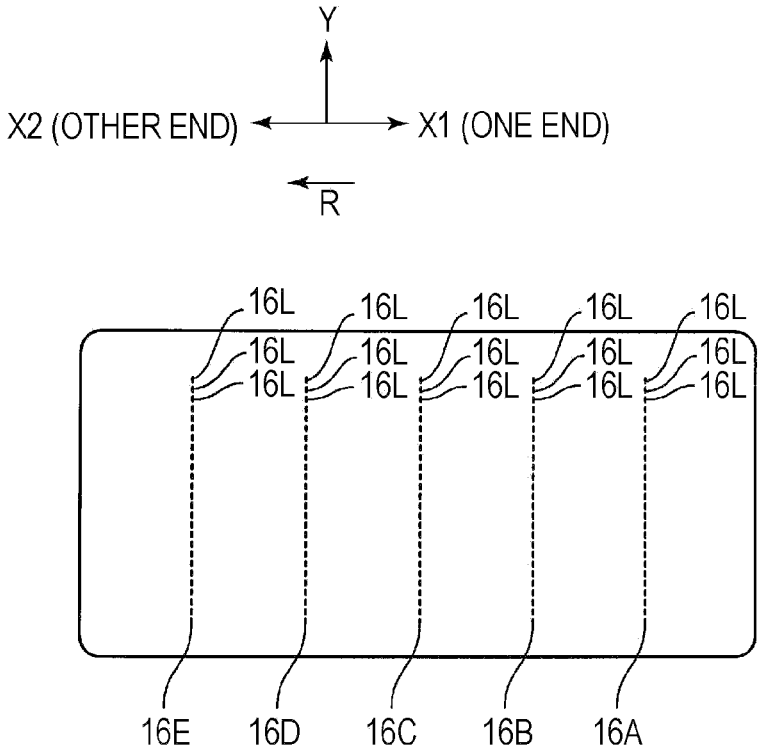
FIG. 4 is a diagram in a case in which a print head of the print apparatus illustrated in FIG. 2 is viewed from the side of a nozzle formation surface.

As described in FIG. 4, the print head 16 is provided with nozzle columns 16A, 16B, 16C, 16D, and 16E corresponding to the respective types of ink. That is, in the embodiment, five nozzle columns are provided, the nozzle column 16A is used for metallic ink ejection, and the nozzle columns 16B, 16C, 16D, and 16E are used for Y-ink, M-ink, C-ink, and K-ink ejection. That is, the print head 16 ejects the plurality of types of ink. Each of the nozzle columns is provided with a plurality of nozzles 16L, and the nozzles in each of the nozzle columns are arranged along the sub-scanning direction. In addition, the five nozzle columns 16A, 16B, 16C, 16D, and 16E are arranged along the main scanning direction.

In the printer 8 including the above-described configuration, transport of the lens sheet 1 in the sub-scanning direction and reciprocating movement of the print head 16 in the main scanning direction are intermittently and alternately performed. In addition, the print head 16 is driven based on print data transmitted from the PC 9 (see FIG. 3), and a print image can be formed on the print medium 4 of the lens sheet 1 by ejecting ink at a specific timing.

In addition, as illustrated in FIG. 3, the printer 8 includes the carriage movement mechanism 14, the transport mechanism 15, the print head 16, a detector group 25, and a printer control section 26. The printer 8 controls each of the sections (the transport mechanism 15, the print head 16, etc.) based on the print data received from the PC 9, which is a device external to the printer 8, to print a print image on the lens sheet 1 in accordance with the print data. The state in the printer 8 is monitored by the detector group 25, and the detector group 25 outputs a detection result to the printer control section 26. The printer control section 26 controls each of the sections based on the detection result output from the detector group 25.

The detector group 25 includes a rotary encoder (not illustrated) and a lens sheet detection sensor (not illustrated). The rotary encoder detects a rotation amount and a rotation speed of the transport motor 23, the carriage motor 22, etc. A transport amount of the lens sheet 1 and a movement amount of the carriage 13, etc. can be detected based on the detection result of the rotary encoder.

The printer control section 26 performs control of the printer 8. The printer control section 26 includes an interface section 27, a central processing unit (CPU) 28, a memory 29, and a unit control circuit 30. The interface section 27 performs transmission and reception of data between the PC 9 and the printer 8. The CPU 28 is an arithmetic processing device for performing the control of the whole printer 8. The memory 29 is used to obtain an area such as an area for storing a program and a work area for the CPU 28, and includes a storage element such as a random access memory (RAM) and an electrically erasable programmable read-only memory (EEPROM). The CPU 28 controls each of the sections through the unit control circuit 30 in accordance with a program stored in the memory 29.

A print processing program causing the PC 9 to execute a print process of a print image is installed in the PC 9. The print processing program includes a so-called printer driver program, an image processing program, etc., and causes a monitor 9A (see FIG. 2) to display a user interface. In addition, the print processing program creates print data for a print image by processing and synthesizing a plurality of images that are sources of a three-dimensional image or a moving image specified by a user depending on the lens pitch, etc. and then transmits the print data to the printer 8.

The printer 8 performs printing of a print image on the lens sheet 1 in accordance with a disposition pitch, a focal length, etc. of the lenticular lens 2 based on the print data for a print image received from the PC 9. The lens sheet 1 is mounted in the printer 8 so that the print medium 4 side faces the print head 16 and the lenticular lens 2 side is in contact with the platen 12. Thus, the printing on the lens sheet 1 is performed on the back surface side of the lens sheet 1.

In addition, in the printing on the lens sheet 1, when Y-ink that is low visibility ink is ejected from the print head 16 on the side opposite to the mounting side of the lenticular lens 2 of the lens sheet 1, metallic ink as non-low visibility ink is ejected to at least the location to which the Y-ink has been ejected before the ejected Y-ink dries.

Print Process of a Print Image

Figure 5:
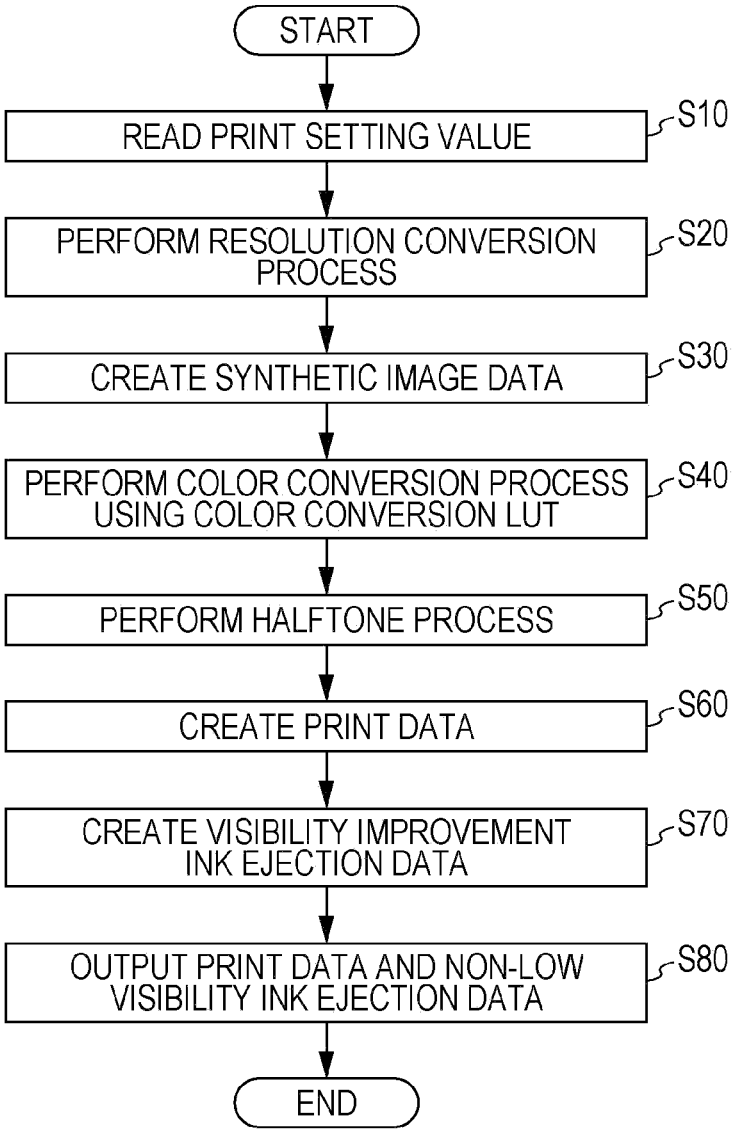
FIG. 5 is a diagram illustrating a flow of operations of the print apparatus illustrated in FIG. 2.

The print process of a print image performed in the print apparatus 7 including the above-described configuration is described with reference to a process flow of FIG. 5.

In the print process, print data for printing a print image on the lens sheet 1 is created. The process for creating the print data is as follows. First, reading of a print setting value is performed (S10). The print setting value includes a pitch of the lenticular lens 2 of the lens sheet 1, a size when print data is printed (size of print data), print resolution, the number of parallaxes P (the number of images used to print a three-dimensional image or a moving image), and the number of aggregate dots D (ratio of minimum print width of the printer 8 to focal line width (aberration width) of the lenticular lens 2).

After the reading of the print setting value, resolution conversion of input image data is performed (S20). In a process of the resolution conversion, calculation of a size compatible with printing is performed for each of pieces of input image data that are sources of synthetic image data obtained after synthesizing the plurality of pieces of image data. For example, when image data before the resolution conversion has 601 pi of lens pitch is, six inch of width direction of a print image, four inch of longitudinal direction of the print image, 720 dpi of print resolution, four parallaxes P, and one aggregate dot D, the image data after the resolution conversion has 360 dots of width direction W (six inch×601 pi, and the width direction W corresponds to the number of lenses) and 2880 dots of longitudinal direction H (720 dpi×four inch).

Next, synthetic image data is created (S30). In the creation of the synthetic image data, the image data after the resolution conversion is segmented into elongated shapes so as to be arranged in each individual convex lens of the lenticular lens 2, and the elongated-shaped image data (segmented image data) of one parallax portion is formed. The other pieces of image data are similarly processed. In addition, the segmented pieces of image data in the respective convex lenses are arranged in order in which the images are changed in the respective convex lenses (in order of visual recognition angle). Therefore, the pieces of image data in an elongated shape that are arranged in the respective convex lenses in parallax order are created, and the creation is performed on all convex lenses. As a result, the synthetic image data is created. For example, when image data after resolution conversion has 360 dots of the width direction W, 2880 dots of the longitudinal direction H, and four parallaxes P, the synthetic image data has 1440 dots of the width direction W and 2880 dots of the longitudinal direction H.

Next, a color conversion process is performed (S40). In the color conversion process, based on a color conversion look-up table (LUT), a color component of the synthetic image data that represented by an RGB color system is converted into a color component of a CMYK color system that can be printed and represented in the printer 8. In addition, a halftone process is performed for the synthetic image data on which the color conversion is performed (S50). Here, the halftone process is a process for performing color reduction from a gradation value of primary color data (256 shades of gray in the embodiment) to a gradation value that can be represented for each pixel in the printer 8.

Next, a process for creating print data from the synthetic image data on which the halftone process is performed (S60). Here, the print data is data including raster data indicating a record state of dots in each main-scanning and data indicating a sub-scanning feed amount and is created with reference to variance data of a not-illustrated variance table.

In addition, in the print processing program, in addition to the above-described print data, metallic ink ejection data is created (S70). The metallic ink ejection data is data for ejecting metallic ink from the print head 16 to the location to which Y-ink has been ejected in the ink absorption layer 5.

In addition, in the print processing program, the print data and the metallic ink ejection data formed as described above are output to the printer 8 (S80).

When the processes in the PC 9 end and then the printer receives the print data and the metallic ink ejection data, the CPU 28 of the printer control section 26 issues a control instruction. The transport motor 23, the carriage motor 22, the print head 16, etc. are driven based on the control instruction to perform printing on the lens sheet 1.

The printer control section 26 performs transport of the lens sheet 1 in the sub-scanning direction and reciprocating movement of the print head 16 in the main scanning direction, forms a print image by ejecting color (Y, M, C, and K) ink from the print head 16 based on the print data and the metallic ink ejection data, and controls metallic ink to be ejected to the location to which Y-ink that is low visibility ink has been ejected, on the back surface side of the lens sheet 1 before the ejected Y-ink dries. The formation of a print image and the ejection of metallic ink are performed, for example, as follows.

In the embodiment, forming of a print image and ejection of metallic ink to the location to which Y-ink has been ejected are performed depending on the movement of the print head 16 toward an outward direction (arrow R direction) that is a direction from one end (arrow X1 side) of the main scanning direction X1-X2 to the other direction (arrow X2 side). The ejection of metallic ink to the location to which Y-ink has been ejected is performed before the ejected low visibility ink dries. When the print head 16 in the outward direction, the transport of the lens sheet 1 is stopped, and a print image is formed when the print head 16 ejects ink to the stopped lens sheet 1 while moving in the outward direction. When the print head 16 moves in the outward direction once, a print image is formed by one line portion that has print width depending on the length of the nozzle columns (length of the arrangement direction of the nozzle). On the other hand, when the print head 16 moves in a homeward direction that a direction toward the one end from the other end, the ink ejection is not performed, and the lens sheet 1 is transported by one line portion depending on the movement of the print head 16 in the homeward direction. As illustrated in FIG. 4, the nozzle column 16A is provided near the rear side (one end side) as compared with the other nozzle columns with respect to the outward direction of the print head 16.

The printer control section 26 intermittently transports the lens sheet 1 for each one line portion, and controls ink having specific color to be ejected from the nozzle columns 16B, 16C, 16D, and 16E to form a print image based on the print data while the print head 16 moves in the outward direction during termination of the transport. In addition, when the print head 16 moves in the outward direction, the printer control section 26 controls metallic ink to be ejected to the location to which Y-ink has been ejected from the nozzle columns 16A arranged nearest the rear side (one end side) of the nozzle columns based on the metallic ink ejection data before the ejected Y-ink dries.

After the printer control section 26 performs formation of a print image and ejection of metallic ink to the location to which Y-ink has been ejected by one line portion while moving the print head 16 in the outward direction, the printer control section 26 moves the print head 16 in the homeward direction to arrange the print head 16 on the one end side. In the movement in the homeward direction, ink is not ejected from the print head 16. The printer control section 26 transports the lens sheet 1 by a specific amount (one line portion) depending on the movement of the print head 16 in the homeward direction. After completion of the transport, the printer control section 26 performs the formation of a print image and the ejection of metallic ink to the location to which Y-ink has been ejected newly by one line portion while moving the print head 16 in the outward direction. A print image is formed on the lens sheet 1 and metallic ink is ejected to the location to which Y-ink has been ejected by repeating the above-described reciprocating movement of the print head, ink ejection, and intermittent transport of the lens sheet 1.

As illustrated in FIG. 4, the nozzle column 16A for ejecting metallic ink is arranged near the rear part as compared with the nozzle columns 16B, 16C, 16D, and 16E with respect to the outward direction. Thus, after a print image is formed on the lens sheet 1 (ink absorption layer 5), the metallic ink can be ejected to the location to which Y-ink has been ejected from the back surface. On the other hand, when a nozzle column for ejecting metallic ink is configured to be provided on the other side across the nozzle columns 16B, 16C, 16D, and 16E in addition to the nozzle column 16A, a print image can be formed in the homeward direction, and the ejection of metallic ink to the location to which Y-ink has been ejected can also be performed. In the outward direction, metallic ink is ejected from the nozzle column 16A, and in the homeward direction, metallic ink is ejected from the nozzle column arranged on the other side.

Figure 7A:
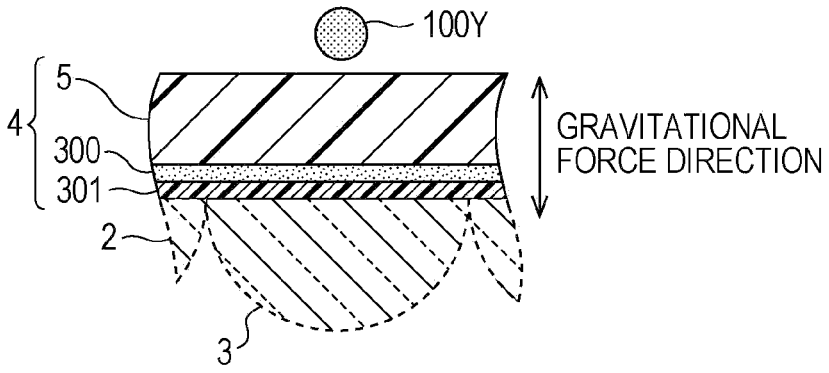
FIGS. 7A to 7C are diagrams illustrating states in which non-low visibility ink is ejected to low visibility ink.
Figure 7B:
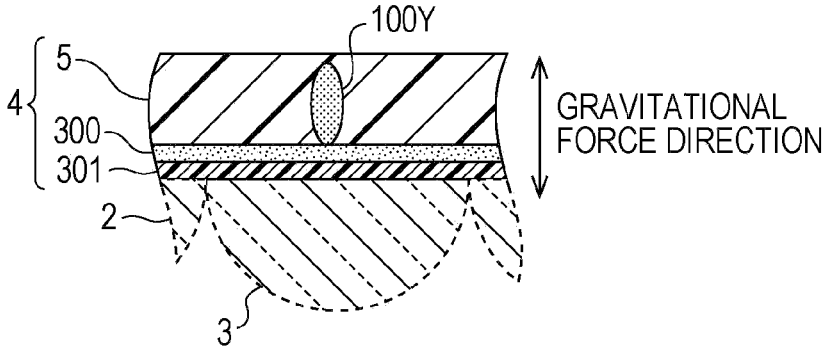
Figure 7C:
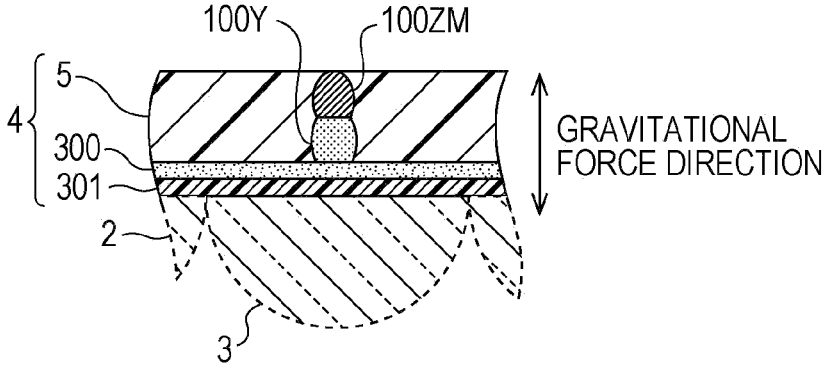

FIGS. 7A to 7C are diagrams illustrating states in which metallic ink 100ZM is ejected to Y-ink 100Y that is low visibility ink (yellow ink) when the Y-ink 100Y is ejected to the print medium 4. When ejection of an ink droplet is performed (printing is performed on the print medium 4), the mounting side of the lenticular lens 2 (lens surface 3 side) faces down in a gravitational force direction, and the Y-ink 100Y for forming an image is ejected on the side opposite to the mounting side of the lenticular lens of the print medium 4 (back surface side of the lenticular lens 2) (FIG. 7A). The Y-ink 100Y is formed in an elongated shape to the lower side of the ink absorption layer 5 in the gravitational force direction (FIG. 7B). Generally, the ink dries in the ink absorption layer 5 as-is, the visibility of the Y-ink 100Y formed in an elongated shape is reduced when viewed through the lenticular lens 2 as compared with a case in which printing is performed on a medium that does not include the ink absorption layer 5. However, in the invention, the metallic ink 100ZM as non-low visibility ink is ejected so as to cover at least the location to which the Y-ink 100Y has been ejected before the Y-ink 100Y dries. Therefore, the Y-ink 100Y before drying is moved by being pushed down to the lenticular lens 2 side that is the lower side of the ink absorption layer 5 by the metallic ink 100ZM (FIG. 7C). Thus, the portion pushed down by the metallic ink 100ZM of the Y-ink 100Y diffused in an elongated shape in the ink absorption layer 5 moves to the lenticular lens side and dries, so that the visibility is improved as compared with the case in which the Y-ink 100Y dries as is in the state as illustrated in FIG. 7B, thereby suppressing the reduction of the visibility. As described above, when non-low visibility ink is the metallic ink 100ZM, light from the lenticular lens 2 side is reflected while being tinged with metallic hue due to a metallic component. When non-low visibility ink is transparent ink instead of the metallic ink 100ZM, the color tone of the Y-ink 100Y is not reduced. When non-low visibility ink is white ink, the color tone of the Y-ink 100Y is not reduced, and light from the lenticular lens 2 side is diffused and reflected. Any one of the above-described types of non-low visibility ink maintains original color tone of the Y-ink 100Y.

Main Effect of the Embodiments

As described above, the print apparatus 7 performs printing on the print medium 4 on which the lenticular lens 2 in which dome-shaped lenses are arranged is mounted and that includes the ink absorption layer 5 absorbing ink. The print apparatus 7 includes the print head 16 that ejects a plurality of types of ink, the PC 9 and the printer control section 26 as a control section that controls the driving of the print head 16, the ink tank 17 that stores the plurality of types of ink. In addition, in a case in which at least one type of ink, of the plurality of types of ink is the Y-ink 100Y the visibility of which is reduced when the ink is absorbed in the ink absorption layer 5, the control section controls, for example, the metallic ink 100ZM to be ejected to at least the location to which the Y-ink 100Y has been ejected as ink different from the Y-ink 100Y the visibility of which is reduced before the Y-ink 100Y dries when the Y-ink 100Y is ejected on the side opposite to the mounting side of the lenticular lens 2 of the print medium 4 from the print head 16.

The print apparatus 7 is configured as described above, so that the visibility of the printed Y-ink 100Y can be improved. White ink may be used as ink different from the ink the visibility of which is reduced in addition to the metallic ink. The white ink does not reduce the color tone of the Y-ink 100Y, and light from the lenticular lens 2 side is diffused and reflected. Therefore, the visibility of the printed Y-ink 100Y can be improved desirably. In addition, clear ink may be used as ink different form the ink the visibility of which is reduced. When transparent ink is used as the ink different form the ink the visibility of which is reduced, the color tone of the Y-ink 100Y is not reduced.

As described above, the printing on the lens sheet 1 includes ejecting the Y-ink 100Y that is low visibility ink on the side opposite to the mounting side of the lenticular lens 2 of the lens sheet 1 from the print head 16 when the Y-ink 100Y that is low visibility ink is included in ink ejected from the print head 16, and ejecting the metallic ink 100ZM that is non-low visibility ink to at least the location to which the Y-ink 100Y has been ejected before the eject Y-ink 100Y dries. The printing is performed as described above, so that the visibility of the printed Y-ink 100Y can be improved.

The control program of the print apparatus 7 for performing printing on the lens sheet 1 includes the print processing program installed in the PC 9 or a program for controlling the printer 8 stored in the memory 29. When the Y-ink 100Y that is low visibility ink is included in ink ejected to the ink absorption layer 5, the control program causes a computer to execute ejecting the Y-ink 100Y on the side opposite to the mounting side of the lenticular lens 2 of the lens sheet 1 from the print head 16 and ejecting the metallic ink 100ZM that is non-low visibility ink to at least the location to which the Y-ink 100Y has been ejected before the ejected Y-ink 100Y dries. The control program is configured as described above, so that the visibility of the printed Y-ink 100Y can be improved.

The lens sheet 1 includes the lenticular lens 2 and the print medium 4 to which the ink absorption layer 5 laminated on the lenticular lens 2 and absorbing ink is provided, and is configured as print sheet in which a print image by Y-ink that is low visibility ink is formed on the lenticular lens 2 side of the ink absorption layer 5 and metallic ink that is non-low visibility ink is placed on the side opposite to the lenticular lens 2 side.

The lens sheet 1 includes the above-described configuration, so that the lens sheet 1 is configured as a print sheet in which the visibility of a print image formed by yellow ink is improved.

In the above description, the Y-ink 100Y is described an example of low visibility ink that is ink the visibility of which is reduced when the ink is absorbed in the ink absorption layer 5, and alternatively, light cyan, light magenta may be used as the low visibility ink in addition to yellow. At least one of the types of low visibility ink is stored to the ink tank 17 of the print apparatus 7, and non-low visibility ink that is ink different from the ink the visibility of which is reduced is ejected to at least the location to which the low visibility ink has been ejected before the low visibility ink dries when the low visibility ink is ejected.

In the above-described the print apparatus 7, metallic ink is stored in the ink tank 17A of the ink tank 17 in which a plurality of types of ink are stored, as non-low visibility ink, and alternatively, all of the ink tanks 17B to 17E and the ink tank 17A may be configured to store low visibility ink. When the configuration is performed as described above, another ink tank that stores mere non-low visibility ink is provided in the print apparatus 7 in addition to the ink tank 17, and non-low visibility ink stored in the ink tank is ejected to the location to which low visibility ink has been ejected.

First Modification

Figure 6:
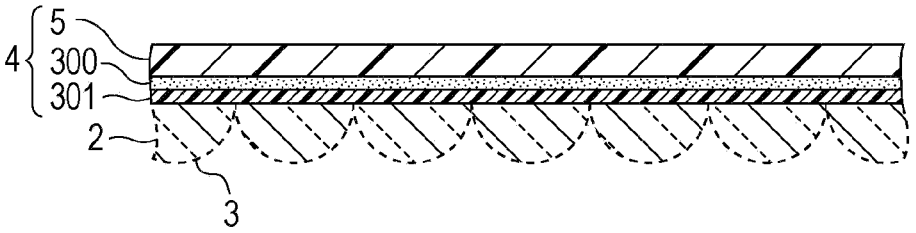
FIG. 6 is a diagram illustrating configuration of a print medium on which a lenticular lens is not mounted.

When printing is performed on the print medium 4, as described above, the lenticular lens 2 may be mounted on the print medium 4, and alternatively, printing is performed on the print medium 4 on which the lenticular lens 2 is not mounted in order to prevent the lenticular lens 2 from being damaged in the printing, and then the print medium 4 and the lenticular lens 2 may be bonded to each other by the bonding layer 300. In this case, as illustrated in FIG. 6, a release film 301 is provided outside the bonding layer 300 of the print medium 4 in order to prevent the bonding layer 300 from being bonded to a structure on the print apparatus 7 side such as the platen 12. In addition, the release film 301 is removed to bond the lenticular lens 2 and the print medium 4 after completion of the printing. A transparent protection layer (not illustrated) may be formed on the lenticular lens 2 side (lenticular lens 2 side of the bonding layer 300 side) to bond the transparent protection layer of the lenticular lens 2 to the print medium 4 through the bonding layer 300.

Second Modification

The print apparatus 7 described in the above-described embodiment performs ejection of metallic ink to the location to which Y-ink has been ejected before the Y-ink printed to the print medium 4 dries, and alternatively, after the Y-ink dries, the Y-ink may be formed on the mounting side of the lenticular lens 2 in the ink absorption layer 5 and metallic ink may be formed on the side opposite to the mounting side. The Y-ink ejected in the outward direction dries before the movement in the homeward direction is started after the movement of the print head 16 in the outward direction is finished. Therefore, after the ejection of the Y-ink and the metallic ink in the outward direction of the print head 16 is performed, the metallic ink is further ejected to the location to which the metallic ink has been ejected in the outward direction again when the print head 16 moves in the homeward direction. As a result, after the Y-ink dries, the Y-ink can be ejected to the mounting side of the lenticular lens 2 in the ink absorption layer 5, and the metallic ink can be ejected on the side opposite to the mounting side.

As described above, after the Y-ink dries, the Y-ink is formed on the mounting side of the lenticular lens 2 in the absorbing layer 5, the metallic ink is formed on the side opposite to the mounting side, so that the visibility of the printed Y-ink can be further improved. The non-low visibility ink further ejected after the Y-ink dries may be clear ink or white ink in addition to the metallic ink.

Third Modification

Figure 8:
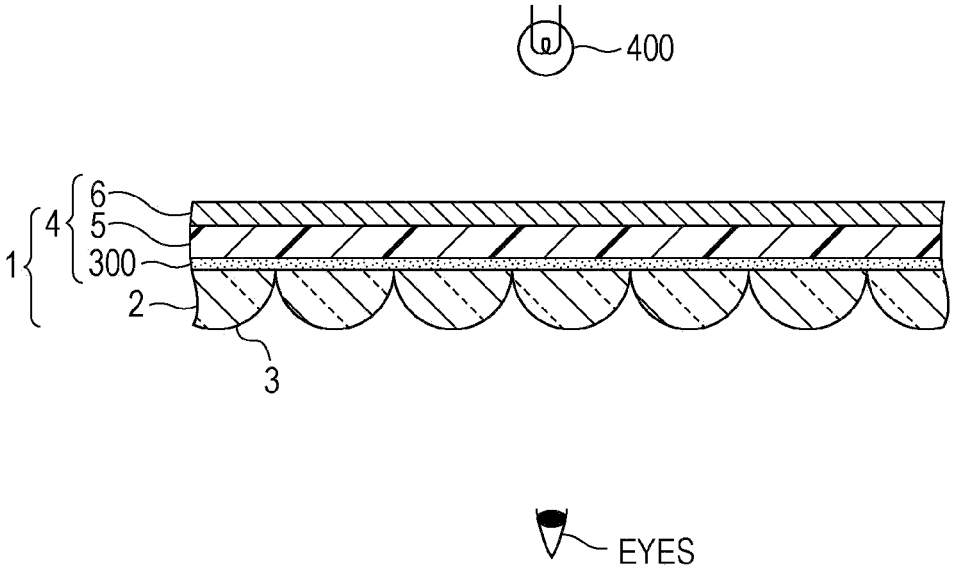
FIG. 8 is a diagram illustrating configuration of a lens sheet of which an ink permeation layer is provided on the back surface side.

As illustrated in FIG. 8, in the lens sheet 1, an ink permeation layer 6 may be configured to be provided on the back surface side of the ink absorption layer 5. The ink permeation layer 6 passes ink ejected on the ink permeation layer 6 side and the ink reaches the ink absorption layer 5. The ink permeation layer 6 is a semi-permeable layer, is semi-permeable to light, and scatters the light. In the lens sheet 1 illustrated in FIG. 8, a print image formed on the ink absorption layer 5 is viewed from the lenticular lens 2 side by radiating back light from the side opposite to the lenticular lens 2 by a light source 400.

Figure 9A:
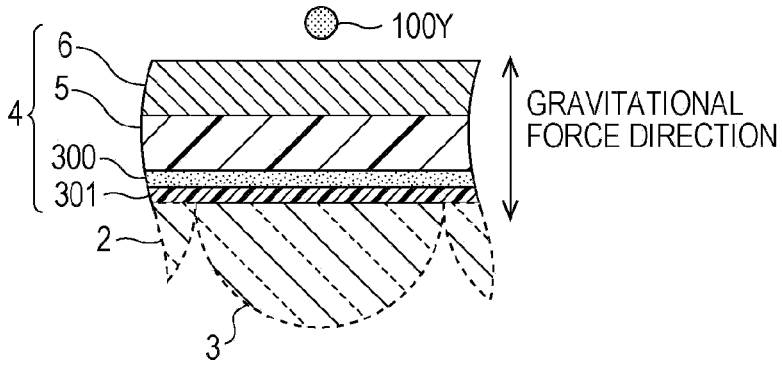
FIGS. 9A to 9C are diagrams illustrating states in which the non-low visibility ink is ejected to the low visibility ink ejected to the lens sheet illustrated in FIG. 8.
Figure 9B:
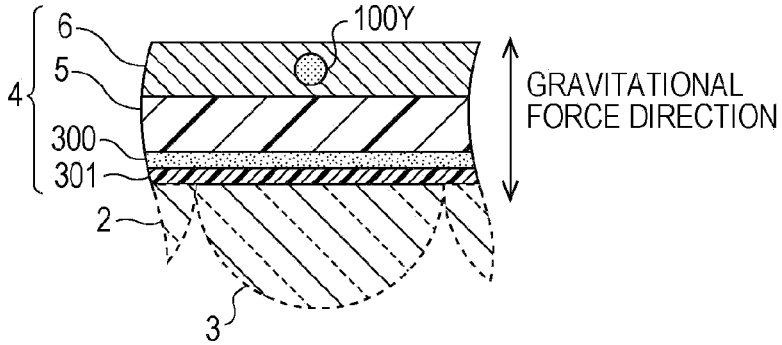
Figure 9C:
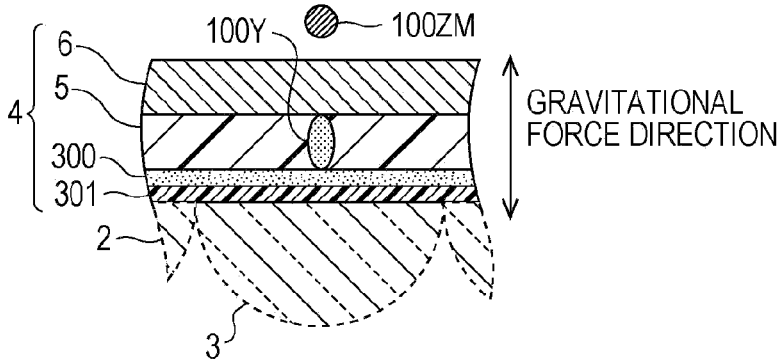
Figure 9D:
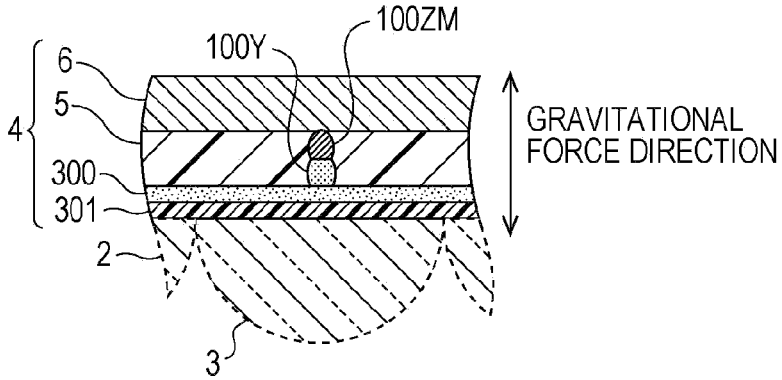

As described above, FIGS. 9A to 9D illustrate the ink permeation layer 6 laminated on the ink absorption layer 5 of the side opposite to the lenticular lens 2 side. A print image formed on the ink absorption layer 5 is mainly used to be viewed from the lenticular lens side by radiating backlight from the side opposite to the lenticular lens 2 side. The ink permeation layer 6 is semi-transparent milky white. When printing is performed on the print medium 4, the lenticular lens 2 may be mounted on the print medium 4, and alternatively, printing is performed on the print medium 4 without mounting the lenticular lens 2 on the print medium in order to prevent the lenticular lens 2 from being damaged, and then the print medium 4 and the lenticular lens 2 may be bonded to each other by the bonding layer 300. In the print medium 4, the release film 301 is provided outside the bonding layer 300. After completion of the printing, the release film 301 is removed to bond the lenticular lens 2 and the print medium 4. A transparent protection layer (not illustrated) may be formed on the lenticular lens 2 side (lenticular lens 2 side of the bonding layer 300) to bond the transparent protection layer of the lenticular lens 2 and the print medium 4 through the bonding layer 300. When ejection of an ink droplet is performed, the mounting side of the lenticular lens 2 face down in a gravitational force direction, and the Y-ink 100Y for forming an image is ejected on the side opposite to the mounting side of the lenticular lens 2 of the print medium 4 (FIG. 9A). The ink is ejected from the ink permeation layer 6 side. The Y-ink 100Y passes through the ink permeation layer 6 (FIG. 9B). The Y-ink 100Y for forming an image reaches the ink absorption layer 5 after passing through the ink permeation layer 6 and is formed in an elongated shape to the lower side of the ink absorption layer 5 in the gravitational force direction (FIG. 9C). Generally, the ink dries in the ink absorption layer 5 as-is, the visibility of the Y-ink 100Y that is an ink droplet formed in an elongated is reduced when viewed through the lenticular lens 2 as compared with a case in which printing is performed on a medium that does not include the ink absorption layer 5. However, in the invention, another ink 100Z (transparent ink, white ink, metallic ink, etc.) is ejected so as to cover at least the location to which the Y-ink 100Y has been ejected before the Y-ink 100Y dries. Therefore, the Y-ink 100Y before drying is moved by being pushed down to the lenticular lens 2 side that is the lower side of the ink absorption layer 5 by the ink 100Z. Thus, the portion pushed down by the ink 100Z of the Y-ink 100Y diffused in an elongated shape in the ink absorption layer 5 moves to the lenticular lens side and dries (FIG. 9D). As a result, the visibility is improved as compared with the case in which the Y-ink 100Y dries as is in the state as illustrated in FIG. 9C, thereby suppressing the reduction of the visibility.

Fourth Modification

Figure 10A:
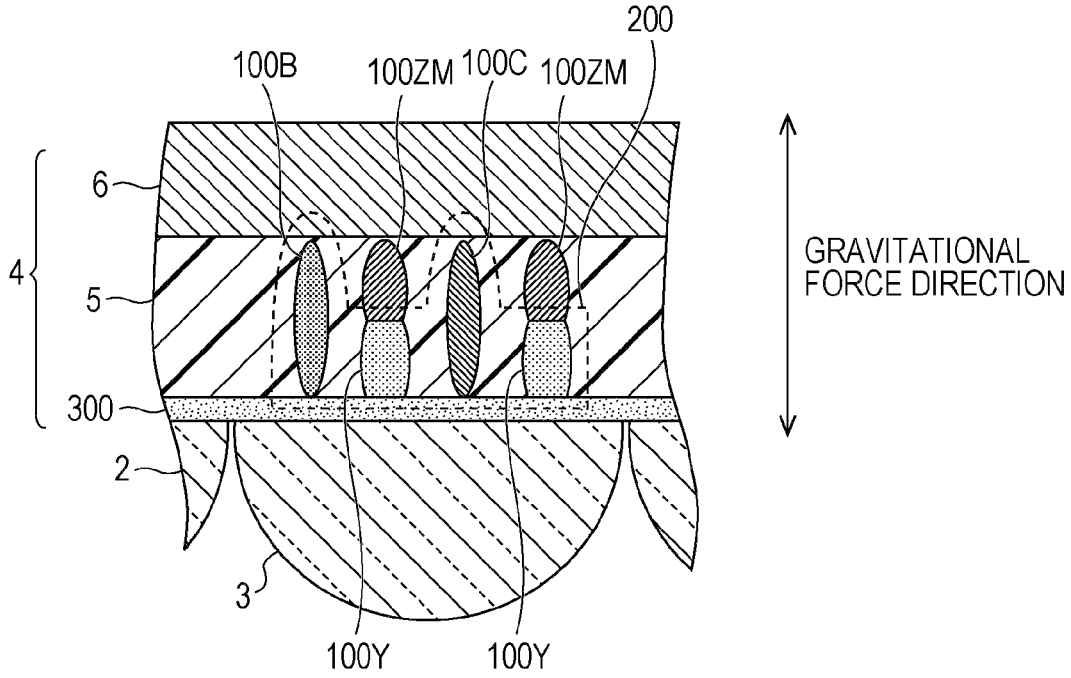
FIGS. 10A and 10B are diagrams illustrating relations between image formation ink and non-low visibility ink.
Figure 10B:
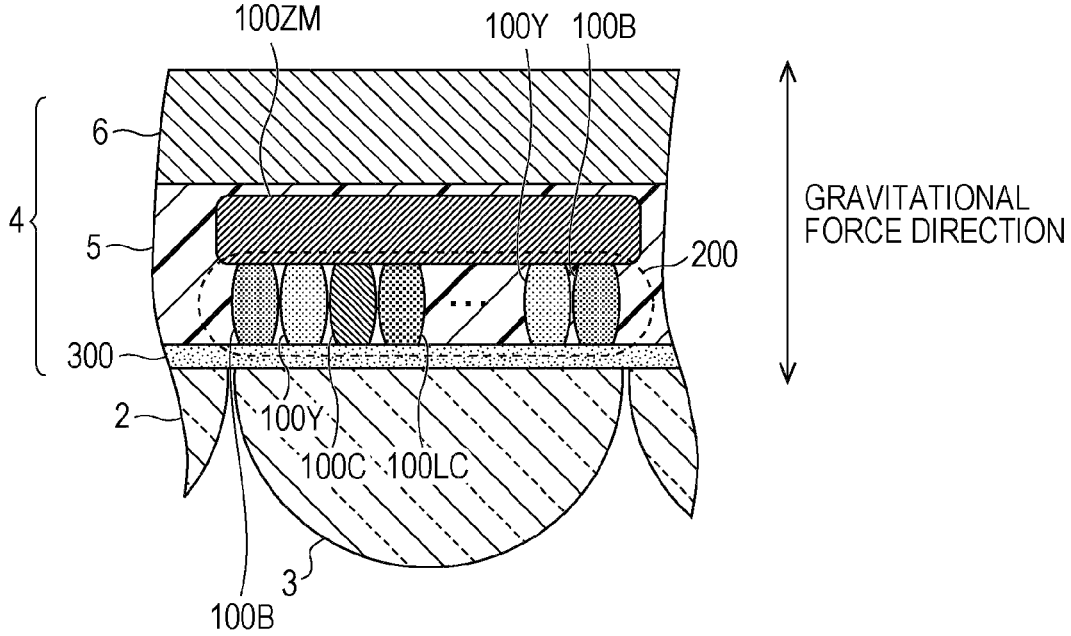

FIGS. 10A and 10B are diagrams illustrating a state of image formation ink formed in the ink absorption layer 5 and a state of the ink 1002 of which the reduction of the visibility is suppressed. When the print apparatus 7 ejects low visibility ink (for example, the Y-ink 100Y and the light cyan ink 100LC) the visibility of which is reduced when the low visibility ink is absorbed in the ink absorption layer 5 and ejects ink (for example, black ink 100B and cyan ink 100C) of which reduction of the visibility when the ink is absorbed in the ink absorption layer 5 is small as compared with the low visibility ink to form a print image 200 that includes dots of the both types of ink, the control section may control the metallic ink 100ZM to be ejected, as non-low visibility ink different from the types of ink, on the side opposite to the lenticular lens 2 side on which the ink the visibility of which is reduced and ink of which reduction of the visibility is small in the ink absorption layer 5 that are placed.

As illustrated in FIG. 10A, the metallic ink 100ZM may be ejected to the location to which the Y-ink 100Y and the light cyan ink 100LC have been ejected, and even in this way, reduction of the visibility of dots and a print image including the dots that is formed by the ink of which reduction of the visibility is small such as the black ink 100B and the cyan ink 100C as compared with the low visibility ink can be suppressed because the black ink 100B and the cyan ink 100C originally have high visibility. Therefore, consumption of the metallic ink 100ZM that suppresses the reduction of the visibility can be reduced.

In addition, as illustrated in FIG. 10B, regardless of the color of ink ejected to form the print image 200, the metallic ink 100ZM may be ejected. In addition to the locations to which the Y-ink 100Y and the light cyan ink 100LC the visibility of which are reduced are ejected, the metallic ink 100ZM is ejected to the locations to which the black ink 100B and the cyan ink 100C are ejected the visibility of which is originally high and the reduction of the visibility is small (there is no issue of reduction of the visibility). That is, the metallic ink 100ZM is ejected to the whole print image 200 including the dots by the ink the visibility of which is reduced when the ink is absorbed in the ink absorption layer 5 (whole image including the dots of the Y-ink 100Y and the light cyan ink 100LC the visibility of which is reduced when the ink is absorbed in ink absorption layer 5 in addition to the dots of the black ink 100B and the cyan ink 100C of which there is no issue of reduction of the visibility when the ink is absorbed in the ink absorption layer 5) before the Y-ink 100Y and the light cyan ink 100LC dry, so that an image is formed on the lenticular lens 2 side of the ink absorption layer 5 in the print image 200 image, and the metallic ink 100ZM is ejected and formed on the side opposite to the lenticular lens 2 side for the whole area of the print image 200.

Fifth Modification

Figure 11A:
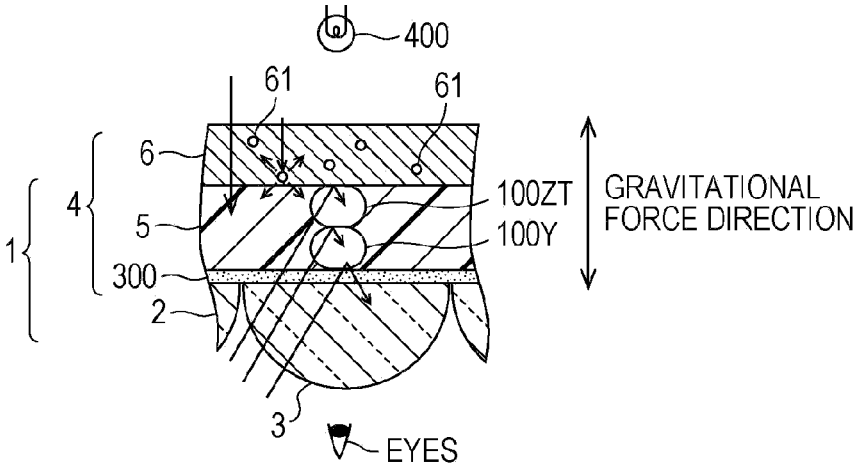
FIGS. 11A to 11C are diagrams illustrating examples of a case in which an ink permeation layer 6 is semi-permeable so as to scatter light.
Figure 11B:
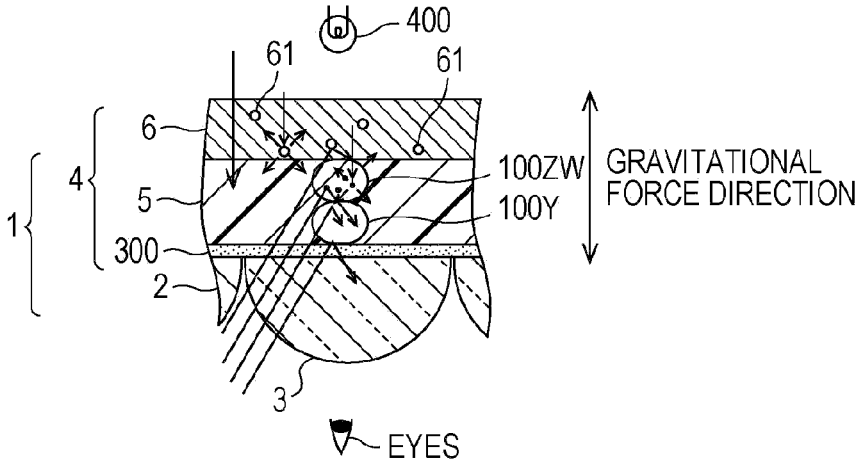
Figure 11C:
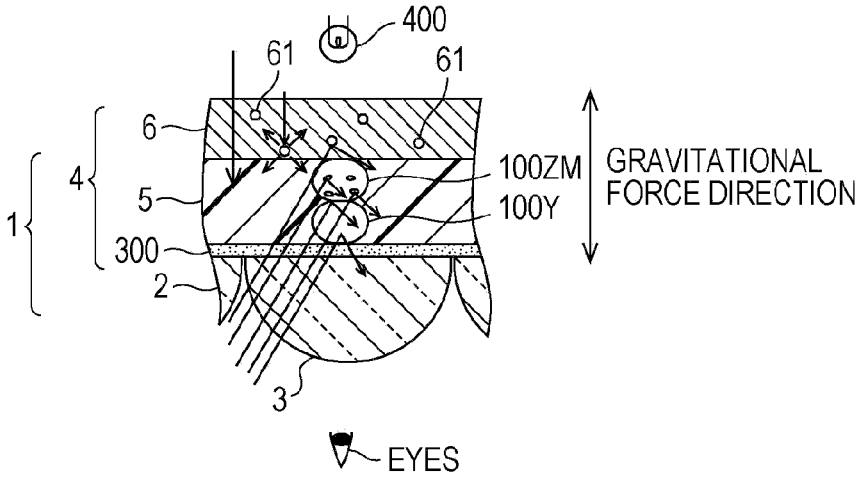

As illustrated in FIGS. 11A to 11C, the ink permeation layer 6 laminated on the ink absorption layer 5 on the side opposite to the mounting side of the lenticular lens 2 may be semi-permeable so as to scatter light. FIGS. 11A to 11C are diagrams illustrating states viewed from the lenticular lens 2 side when radiating backlight by the light source 400 from the side opposite to the lenticular lens 2 on the lens sheet 1 (print medium 4 on which the lenticular lens 2 is mounted) of which a print image is formed on the print medium 4 (ink absorption layer 5) by ink dots. FIG. 11A is a diagram illustrating a state in which a transparent ink 100ZT is used as ink of which reduction of the visibility is suppressed. The backlight is scattered by a white particle 61 in the ink permeation layer 6. Light from the lenticular lens 2 side is also scattered by the white particle 61 in the ink permeation layer 6. The light from the lenticular lens 2 side is reflected at a portion in which the Y-ink 100Y is placed, a boundary between the portion in which the Y-ink 100Y is placed and a portion in which the transparent ink 100ZT is placed, and a boundary between the portion in which the transparent ink 100ZT is placed and the ink absorption layer 5. The Y-ink 100Y is pushed down to the lenticular lens 2 side by the transparent ink 100ZT, so that reduction of the visibility is suppressed.

FIG. 11B is a diagram illustrating a state in which white ink 100ZW is used as ink of which reduction of the visibility is suppressed. The backlight is scattered by the white particle 61 in the ink permeation layer 6. Light from the lenticular lens 2 side is also scattered by the white particle 61 in the ink permeation layer 6. The light from the lenticular lens 2 side is reflected at a portion in which the Y-ink 100Y is placed, a boundary between the portion in which the Y-ink 100Y is placed and a portion in which the transparent ink 100ZT is placed, and a boundary between the portion in which the transparent ink is placed and the ink absorption layer 5. The Y-ink 100Y is pushed down to the lenticular lens 2 side by the white ink 100ZW, so that reduction of the visibility is suppressed. In this case, the white ink 100ZW scatters and reflects light from the lenticular lens 2 side and light form the side opposite to the lenticular lens 2 (upper side in FIG. 11B) in addition to the case of FIG. 11A.

FIG. 11C is a diagram illustrating a state in which the metallic ink 100ZM is used as ink of which reduction of the visibility is suppressed. In addition to the case of FIG. 11B, the metallic ink 100ZM includes a metallic component of a particle or a small piece such as aluminum or copper. Therefore, light coming into the metallic ink 100ZM is reflected by the metallic component to become light having a metallic color (metallic light).

The entire disclosure of Japanese Patent Application No. 2011-253722, filed Nov. 21, 2011 is expressly incorporated by reference herein.

What is claimed is:

1. A print apparatus that performs printing on a print medium, wherein said print medium comprises a lenticular lens and an ink absorption layer that is located on a surface opposite to a surface where the lenticular lens is located, said lenticular lens and ink absorption layer being separated by an intermediate layer extending across the entire surface of said ink absorption layer, such that the absorption layer can be seen through the lenticular lens, the print apparatus comprising:

a plurality of types of ink;

a print head that ejects the plurality of types of ink onto the surface of the ink absorption layer opposite the lenticular lens; and a control section that controls driving of the print head, wherein in a case in which at least one type of ink among the plurality of types of ink installed in the print apparatus is a first ink, the visibility of which is reduced after the first ink is absorbed in the ink absorption layer as compared with the visibility before the absorption, when the first ink is ejected from the print head to the ink absorption layer of the print medium, the control section controls a second ink, different from the first ink, to be ejected to at least a location to which the first ink has been ejected before the first ink dries wherein, the control section controls the second ink to be further ejected to a location to which the first ink and the second ink have been ejected and the first ink has dried, wherein the second ink is placed on an upper side of the ink absorption layer when the first ink is placed on a lower side of the ink absorption layer, which is located on the same side as the lenticular lens, wherein the first ink before drying is moved by being pushed down to the lower side by the second ink.

2. The print apparatus according to claim 1, wherein, the control section controls ink different from the first ink and the second ink to be further ejected to the location to which the first ink and the second ink have been ejected and the first ink has dried.

3. The print apparatus according to claim 1, wherein, the first ink is at least one of yellow, light cyan, and light magenta.

4. The print apparatus according to claim 1, wherein, the second ink is at least one of transparent ink, white ink, and metallic ink.

5. The print apparatus according to claim 1, wherein, an ink permeation layer through which ink passes is laminated on a side that receives the ink in the ink absorption layer in the print medium, and the control section controls the first ink to be ejected to the ink permeation layer and controls the second ink to be ejected to the location to which the first ink has been ejected in the ink permeation layer.

6. The print apparatus according to claim 5, wherein, the ink permeation layer is semi-permeable so as to scatter light.

7. A print method that performs printing by ejecting ink on a print medium that includes a lenticular lens and an ink absorption layer that absorbs the ink and is located on a surface opposite to a surface where the lenticular lens is located, separated by an intermediate layer, the print method comprising:

ejecting the ink from a print head to the ink absorption layer of the print medium;

ejecting, when the ejected ink is a first ink the visibility of which is reduced after the first ink is absorbed in the ink absorption layer as compared with the visibility before the absorption, a second ink different from the first ink the visibility of which is reduced to at least a location to which the first ink has been ejected before the first ink dries.

8. The print method according to claim 7, wherein, an ink permeation layer through which ink passes is laminated on a side that receives the ink in the ink absorption layer in the print medium, and the ink permeation layer is semi-permeable so as to scatter light.

9. A print sheet comprising:

a print medium including a lenticular lens and an ink absorption layer located on a surface opposite to a surface where the lenticular lens is located, said lenticular lens and said ink absorption layer being separated by an intermediate layer extending across the entire surface of said ink absorption layer, wherein an image is formed by ink on the surface of the ink absorption layer opposite the lenticular lens, the visibility of which is reduced due to absorption of the ink in a lower side of the ink absorption layer on the lenticular lens side, and ink of which reduction of visibility is suppressed is placed on an upper side opposite to the lenticular lens side, wherein the ink of which reduction of visibility is not suppressed before drying is moved by being pushed down to the lower side by the ink of which reduction of visibility is suppressed.

10. The print sheet according to claim 9, wherein an ink permeation layer through which the ink passes is laminated on a surface of the ink absorption layer on the side opposite to the lenticular lens side in the print medium, and the ink permeation layer is semi-permeable so as to scatter light.

* * * * *